United States Patent [19]

Doi

[11] Patent Number: 4,863,008

[45] Date of Patent: Sep. 5, 1989

[54] APPARATUS FOR TRANSFERRING OBJECTS TO BE PROCESSED SUCH AS EGGS OR THE LIKE

[75] Inventor: Eiji Doi, Okayama, Japan

[73] Assignees: Kewpie Kabushiki Kaisha, Tokyo; Kyowa Kikai Kabushiki Kaisha, Tsuyama, both of Japan

[21] Appl. No.: 180,954

[22] Filed: Apr. 13, 1988

[30] Foreign Application Priority Data

Apr. 17, 1987 [JP] Japan ..... 62-95834

[51] Int. Cl.[4] ..... B65G 47/32

[52] U.S. Cl. ..... 198/433; 198/430; 198/378; 198/418.6

[58] Field of Search ..... 198/424, 426, 430–433, 198/463.2, 463.3, 476.1, 477.1, 592, 597, 598, 600, 576, 577, 378, 418.6

[56] References Cited

U.S. PATENT DOCUMENTS

| | | | |
|---|---|---|---|
| 2,135,778 | 11/1938 | Wyland | 198/433 X |
| 2,961,087 | 11/1960 | Reading | 198/433 X |
| 3,176,821 | 4/1965 | Eldred et al. | 198/426 |
| 3,298,499 | 1/1967 | Ellis et al. | 198/576 X |
| 3,370,691 | 2/1968 | Mosterd | 198/433 |
| 3,857,472 | 12/1974 | Klint | 198/477.1 |
| 3,894,631 | 7/1975 | Rose et al. | 198/424 X |

FOREIGN PATENT DOCUMENTS 0059089 12/1986 Japan .

*Primary Examiner*—Robert J. Spar
*Assistant Examiner*—Lyle K. Kimms
*Attorney, Agent, or Firm*—Oblon, Spivak, McClelland, Maier & Neustadt

[57] ABSTRACT

A transfer apparatus for transferring objects to be processed, susceptible to damage, such as eggs and which includes a delivery conveyor for supplying rows of the objects successively. Adjacent to the delivery end of the delivery conveyor extend a secondary conveyor having a number of supporting stands which are fed in a direction perpendicular to the direction of movement of the delivery conveyor. A transfer device is interposed between the delivery end of the delivery conveyor and the secondary conveyor. The transfer device has a number of object receiving stands. A row of objects delivered from the delivery conveyor is placed on the receiving stands which are temporarily stopped. Thereafter, the receiving stands with the objects thereon are accelerated so as to move in parallel with the supporting stands until they reach the same speed as the supporting stands. Then, the receiving stands are swung to incline toward the supporting stands whereby the objects are tranferred from the receiving stands to the supporting stands. This apparatus enables rapid transfer of objects as well as compact arrangement.

5 Claims, 5 Drawing Sheets

APPARATUS FOR TRANSFERRING OBJECTS TO BE PROCESSED SUCH AS EGGS OR THE LIKE

BACKGROUND OF THE INVENTION

1. Field of the Invention

The present invention relates to a transfer apparatus for continuously transferring at high speed a great number of objects to be processed, for example, substantially spherical objects susceptible to damage, such as eggs, fruits or vegetables. More specifically, the present invention relates to a transfer apparatus of the character wherein objects to be processed are transferred from a delivery conveyor having an array or a plurality of rows of individual receiving seats for the objects to be processed to the next or secondary conveyor such as a selection conveyor having a transfer section which receives the objects to be processed from the delivery conveyor and transfer them in a direction perpendicular to the direction of movement of the delivery conveyor, whereby the objects to be processed can be continuously processed in large quantity at high processing rate.

2. Discussion of the Background

In order to carry out selection and weighing of objects susceptible to damage and to carry out other various processing of objects, such as breaking of eggs, it was a well known practice to manually put objects to be processed on supporting stands carried by a conveyor, respectively.

As an alternative, Japanese Patent Publication (Kokoku) No. 53-13552 published May 11, 1978 discloses an apparatus in which objects to be processed are transferred from a delivery conveyor to a secondary conveyor such as weighing means through cup-shaped members (receiving stands) mounted on and along a rod which can be rotated about its longitudinal axis and which is disposed perpendicularly to the direction of movement of the delivery conveyor, which has a plurality of rows each consisting of a plurality of individual object receiving seats.

Japanese Patent Publication No. 61-59089 published Dec. 15, 1986 discloses an apparatus in which an egg transfer device is disposed perpendicular to the direction of movement of an egg delivery conveyor and in parallel with a secondary conveyor so as to move in the same direction and at the same speed as the secondary conveyor.

According to the first mentioned practice in which the objects to be processed are manually handled, the objects are seldom damaged, but the handling efficiency is extremely low so that this practice is not adapted to rapid handling of a large quantity of objects.

According to the transfer apparatus disclosed in the above-mentioned Japanese Patent Publication No. 53-13552, in order to process continuously the objects at high processing rate, transfer of each object must be carried out within a limited time interval, but since the cup-shaped members must be moved reciprocally between two positions, the reciprocal movement of the transfer device for the transfer of the objects must be made at a considerably high speed. As a result, during the receipt and transfer of the objects to be processed, the posture of each object becomes unstable and the objects tend to receive impacts so that this transfer apparatus is also not adapted for processing the objects at high speed.

According to the transfer apparatus disclosed in the above-mentioned Japanese Patent Publication No. 61-59089, the transfer device moves in parallel with the secondary conveyor at the same speed as the latter so that smooth transfer of the objects to be processed to the secondary conveyor is ensured, but in the case of the receipt of the objects to be processed from the delivery conveyor, the objects are delivered to the transfer device which is moving relative to the delivery conveyor in the direction perpendicular to the direction of the movement of the transfer device so that the posture of the received objects inevitably become unstable. Therefore, positive and reliable transfer of the objects from the transfer device to the second conveyor is not ensured.

SUMMARY OF THE INVENTION

In view of the above, the primary object of the present invention is to provide a transfer apparatus capable of transferring at high speed the objects to be processed, susceptible to damage, such as eggs from a delivery conveyor to a secondary conveyor in a continuous and gentle manner.

To the above and other ends, the transfer apparatus in accordance with the present invention comprises a delivery conveyor driven in a first direction for conveying the objects to be processed and having an array of individual receiving seats at which the objects to be processed rest, said array consisting of parallel rows of the receiving seats, spaced apart by a predetermined distance in said direction, each of said rows including a predetermined number of the receiving seats; a secondary conveyor having a conveying section extending in a second direction perpendicular to said first direction of the delivery conveyor and disposed adjacent to a delivery end of the latter, said secondary conveyor having mounted thereon a plurality of supporting stands for receiving thereon said objects, respectively, said supporting stands being spaced apart from each other in said second direction by a distance equal to the distance between adjacent receiving seats of the same row; means for driving said secondary conveyor at a constant speed in a manner to cause the conveying section thereof to move in said second direction; and transfer means interposed between the delivery end of the delivery conveyor and the conveying section of the secondary conveyor for receiving at one time a lot of objects on each row of the receiving seats of the delivery conveyor to transfer the objects onto the supporting stands of the secondary conveyor, respectively, said transfer means having a plurality of object receiving stands spaced apart from each other in a direction parallel to said second direction by a distance equal to the distance between adjacent receiving seats of the same row for receiving the lot of objects thereon, respectively, and then transferring the same onto the supporting stands. According to the characterizing feature of the present invention, the transfer means comprises: endless conveying means having a section which extends in said direction parallel to said second direction and carries said receiving stands thereon, each of said receiving stands being mounted to be movable between a first position in which one of the objects is received thereon and a second position in which the object received is transferred to one of the supporting stands; intermittent drive means for driving said endless conveying means so as to move said receiving stands in said direction parallel to said second direction; control means for controlling said drive means in such a manner that when the receiving stands receive thereon a lot of objects from the delivery conveyor, said endless conveying means is stopped with a set of the receiving stands aligned with respect to said first direction with the receiving seats, respectively, and then said endless conveying means is moved and accelerated in said second direction until the receiving stands, which have received the objects thereon, have the same speed as the supporting stands and take positions adjoining the supporting stands moving in parallel, respectively; and means for acting on said set of the receiving stands to cause each of the same to move from said first position to said second position when said receiving stands have taken the positions adjoining the supporting stands thereby to transfer at a time the lot of the objects on the set of the receiving stands onto the supporting stands.

In the section in which the objects to be processed are received and then transferred, each of the object receiving stands of said transfer means moves in the same direction as the direction of the movement of the secondary conveyor; that is, in the direction perpendicular to the direction of the movement of the delivery conveyor. The individual receiving seats of the delivery conveyor, the receiving stands of the transfer means and the supporting stands of the secondary conveyor are spaced apart from each other by the same distance.

The receiving stands which are stopped by the intermittent drive means receive a row or lot of objects to be processed from the delivery conveyor in a smooth manner.

Thereafter the intermittent drive means accelerates the receiving stands to the same speed as the supporting stands and then they move in the same direction parallel with each other. When they become parallel with each other, the receiving stands of the transfer means are caused to move to their second positions toward the supporting stands of the secondary conveyor so that the lot of objects to be processed can be gently transferred from the transfer means to the secondary conveyor without receiving any substantial impact forces.

Succeeding objects to be processed are also continuously received from the delivery conveyor to the transfer means and then transferred to the secondary conveyor in the same manner as above.

The receiving stands of the transfer means are mounted on an endless chain, for example, and are moved in a predetermined direction and the objects to be processed are gently transferred to the secondary conveyor when they become parallel with the supporting stands of the secondary conveyor.

Therefore, as compared with the conventional practice of supplying objects to be processed manually to the secondary conveyor and as compared with the apparatus in which reciprocal movement of the receiving stands is carried out, the apparatus of the present invention can transfer a large quantity of objects to be processed at higher speed without loss of the time required for returning the receiving stands to their initial positions.

Further, as compared with the apparatus in which the transfer device always moves at the same speed as that of the secondary conveyor, in the case of the transfer means used in the present invention, the receiving stands receive a lot of objects to be processed while the receiving stands are once stopped whereby positive and reliable transfer of the objects to be processed can be ensured. Furthermore, since the receiving stands are accelerated, after receiving objects thereof, to catch up with the continuously moving support stands of the secondary conveyor for transferring the objects to the support stands while the receiving stands and the supporting stands are moving parallel at the same speed, the operation of the transfer is carried out in a short period of time and in a gentle and smooth manner without damaging the objects.

The above and other objects, effects and features of the present invention will become more apparent from the following description of a preferred embodiment thereof taken in conjunction with the accompanying drawings.

DESCRIPTION OF THE PREFERRED EMBODIMENT

In the following description of the preferred embodiment of the present invention, it is assumed that an object to be processed is an egg.

Figure 1:
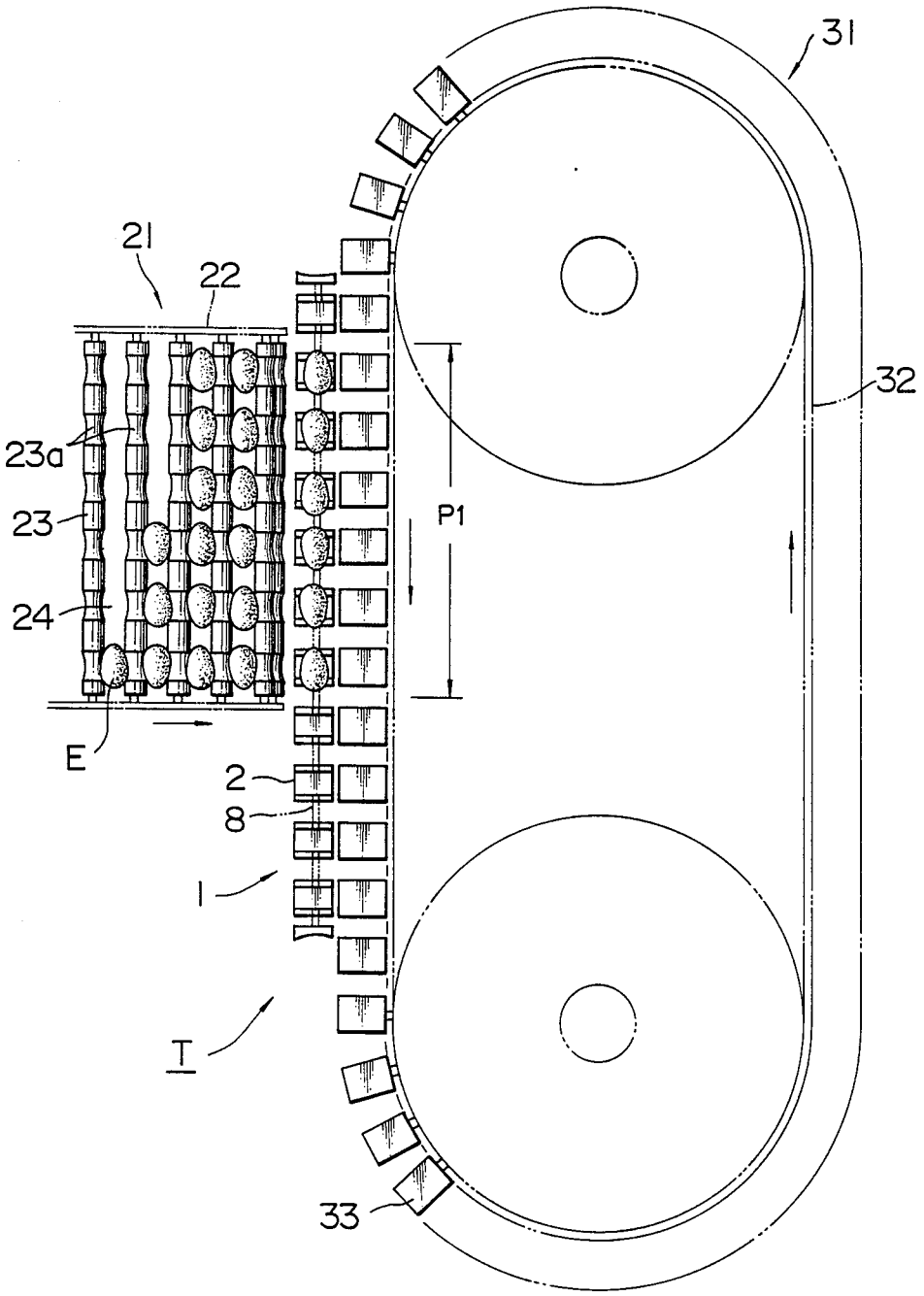
FIG. 1 is a schematic plan view illustrating the arrangement of a preferred embodiment of the transfer apparatus according to this invention, the view showing a state of receiving from a delivery conveyor a plurality of objects to be processed.

Referring first to FIG. 1, the transfer apparatus according to this invention is generally designated by T and comprises a delivery conveyor 21, a secondary conveyor 31 and a transfer device 1 interposed between the two conveyors 21 and 31.

Figure 4:
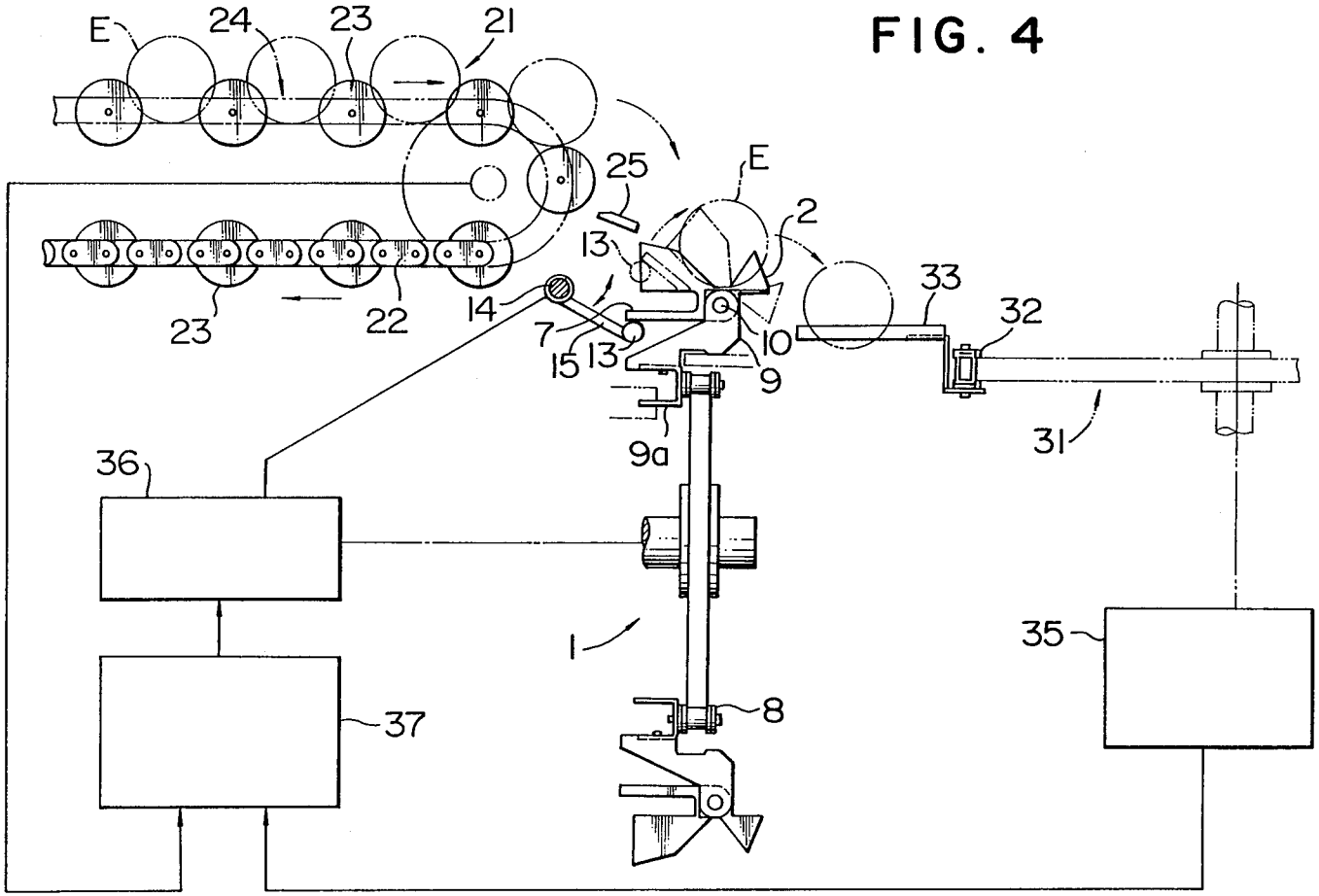
FIG. 4 is a front view of a transfer device, the delivery conveyor and the secondary conveyor.

The delivery conveyor 21 comprises a plurality of rollers 23 interposed between a pair of parallel endless chains 22 spaced apart from each other by a predetermined distance. The chains 22 are passed around sprocket wheels as shown in FIG. 4 and driven by the wheels in the arrow marked directions. Six individual object receiving seats 24 are defined between concavely reduced portions **23*a* of adjacent rollers 23, the reduced portions 23*a* of each roller 23 being spaced apart by a suitable distance from each other in the axial direction of the roller 23. Each individual receiving seat 24 receives one egg E as shown in FIG. 1. Therefore, upon advancing movement of the chains 22, a row or lot of six eggs E is continuously delivered at the delivery end of the conveyor 21 to receiving stands 2 of the transfer device 1 at a predetermined time interval. In FIG. 4, reference numeral 25 represents a guide plate serving to guide the eggs E from the seats 24 to the stands 2**.

The secondary conveyor 31 is in this embodiment a conventional selection conveyor and has a series of supporting stands 33 mounted at predetermined intervals on an endless chain 32 which is driven in the direction of arrow at a predetermined speed in a horizontal plane. The stands 33 are spaced apart from each other by the same distance as that between the adjacent receiving seats 24 of each roller 23. In order to transfer the eggs E from the delivery conveyor 21 through the transfer device 1 to the secondary conveyor 31, the latter has a section in which the supporting stands 33 are moved in a second direction which is perpendicular to the (first) direction in which the delivery conveyor 21 is moved. The secondary conveyor 31 is driven by a driving device 35 shown in FIG. 4.

The transfer device 1 interposed between the conveyors 21 and 31 will be described in detail hereinafter.

Referring to FIGS. 6–10, the receiving stand 2 of the transfer device 1 is swingable and has a pair of spaced apart delivery-conveyor-side projections 4 of substantially trapesoidal shape disposed on the side of the stand 2 adjacent to the delivery conveyor 21, and a pair of spaced apart secondary-conveyor-side projections 5 of triangular shape disposed on the side of the stand 2 adjacent to the secondary conveyor 31 and spaced apart from the projections 4 by a small distance on the top surface 3 of the stand 2. Each projection 5 has inclined surfaces **5*a* and 5*b*. Each of the projections 4 has a top surface 4*a* which is inclined at a relatively small angle downwardly toward the secondary conveyor 31 and joins a top surface 4*b* inclined at a relatively large angle. The opposing surfaces 4*c* of the projections 4 and the opposing surfaces 5*c* of the projections 5 are inclined downwardly toward each other. Each of the inclined opposing surfaces 4*c* is cut such that it is more gently inclined as it extends toward the delivery conveyor 21 and is more steeply inclined as it extends toward the conveyor 31. In other words, as most clearly shown in FIG. 7, the inclined surfaces 4*c* of the projections 4 are defined so as to positively and reliably receive the eggs E delivered from the delivery conveyor 21 by causing the width W of the space between the pair of the projections 4 to be gradually narrowed toward the secondary conveyor 31. The inclined surfaces 5*c* of the triangular projections 5 are defined so as to approach each other as they extend toward the top surface 3. Therefore, the egg E delivered from the delivery conveyor 21 is guided by the inclined surfaces 4*c* to roll on the top parts of the projections 4 and then is correctly and securely seated between the projections 4 and 5. Thereafter, when the swingable receiving stand 2 is swung to be inclined toward the supporting stand 33 of the secondary conveyor 31 due to its pivotal mounting to be described below, the egg E is correctly and softly guided by the inclined surfaces 5*c* of the projections 5 and transferred onto the supporting stand 33 (See FIG. 4**).

Reference numeral 6 designates a mounting leg of the swingable receiving stand 2 which is loosely fitted over a pivot shaft 10 to be described hereinafter. Furthermore, reference numeral 7 indicates a tail or follower part extended from the lower part of the leg 6 toward the delivery conveyor 21.

The top surface 3, the projections 4 and 5, the mounting leg 6 and the follower part 7 are integrally formed or molded into the receiving stand 2 preferably from a synthetic resin. It is to be understood, however, that the present invention is not limited to the construction and the material described above and that the receiving stand can be modified depending upon the shape of objects to be processed.

Figure 5:
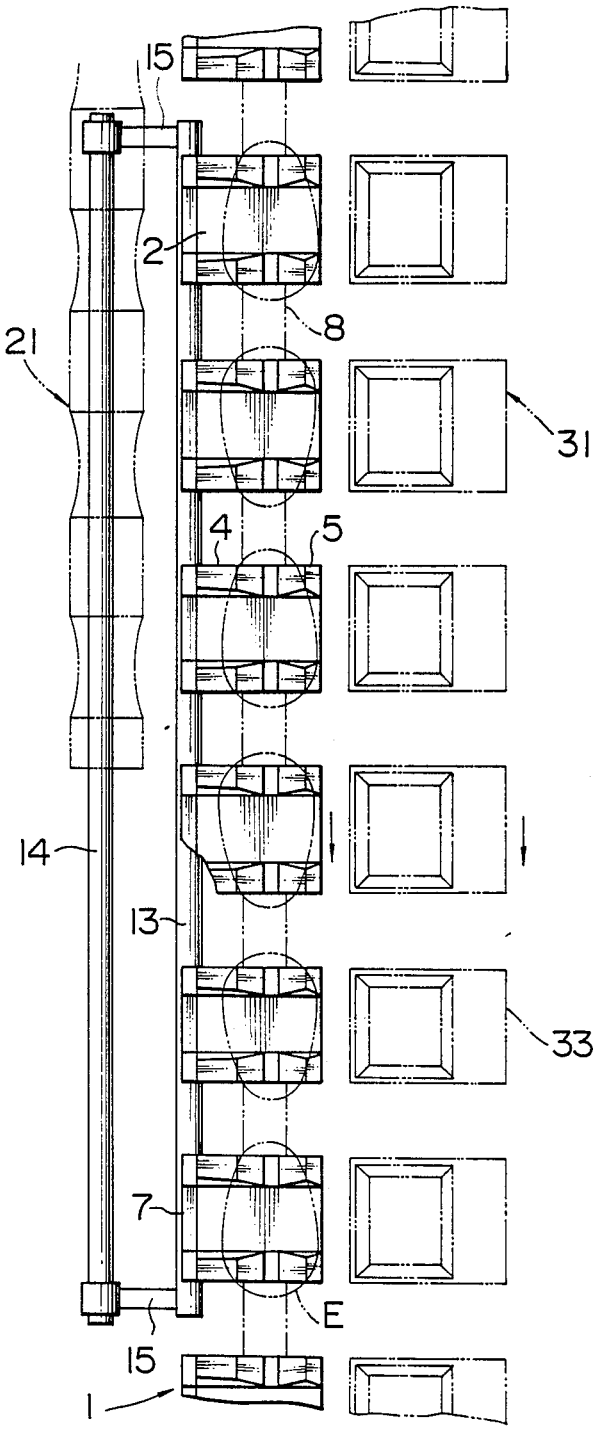
FIG. 5 is a top view on an enlarged scale, illustrating major components thereof.
Figure 6:
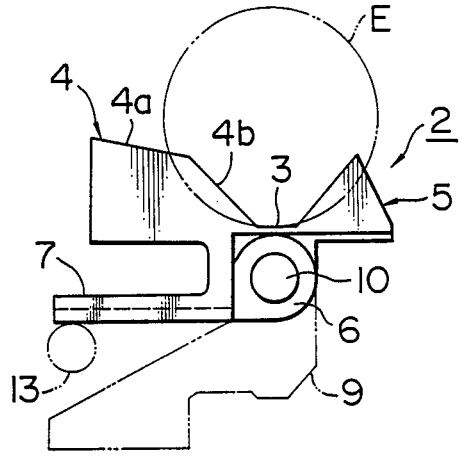
FIG. 6 is a front view, on a further enlarged scale, of a swingable receiving stand.
Figure 9:
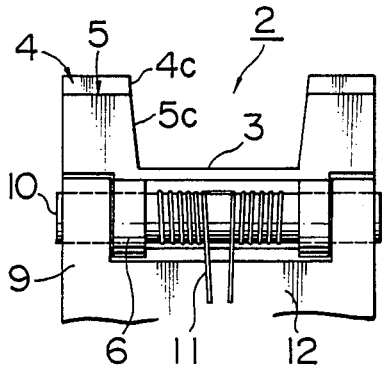
FIG. 9 is a right side view of FIG. 8.
Figure 7:
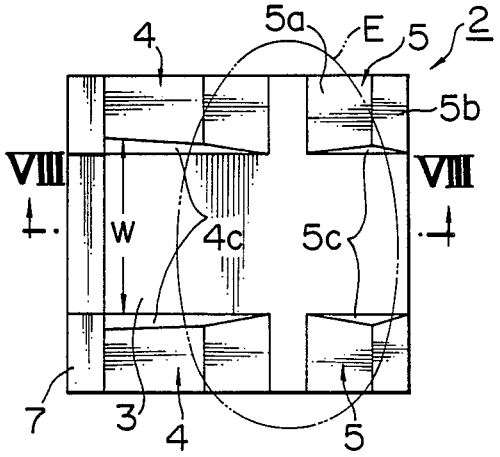
FIG. 7 is a top view thereof.
Figure 10:
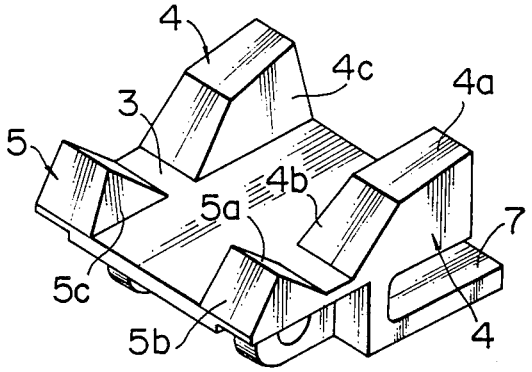
FIG. 10 is a perspective view of the receiving stand.

The swingable receiving stands 2 are mounted on an endless chain 8 adapted to be moved in the same direction as the adjoining span of the secondary conveyor 31. As shown in FIGS. 1, 4 and 5, a plurality of mounting members 9 are attached through an attachment member **9*a* (FIG. 4) to the endless chain 8 at positions spaced apart from each other by the same distance as the distance between adjacent individual receiving seats 24, with respect to the longitudinal direction of the roller 23, of the delivery conveyor 21. Furthermore as shown in FIGS. 6 and 9, each swingable receiving stand 2 is connected to the mounting member 9 by loosely fitting the mounting leg 6 and the top portion of the mounting member 9 over the pivot shaft 10. Therefore, the distance between the adjacent receiving stands 2 is equal to the distance between the adjacent individual receiving seats 24 of the delivery conveyor 21 when the receiving stands 2 are mounted on the endless chain 8**.

Figure 8:
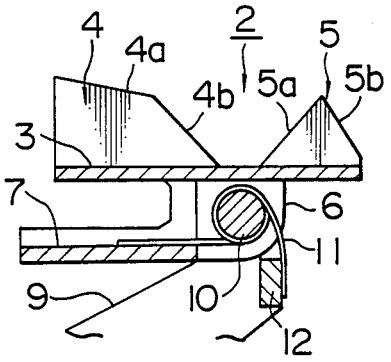
FIG. 8 is a section taken along the line VIII—VIII of FIG. 7.

As shown in FIGS. 8 and 9, coiled springs 11 are fitted over the pivot shaft 10 and one end of each of the coiled springs 11 are engaged with the upper surface of the follower part 7 of the receiving stand 2 while the other ends thereof are engaged with the outer surface of a side wall 12 of the mounting member 9. Therefore, the receiving stand 2 is normally urged in a counterclockwise direction relative to the mounting member 9 under the force of the coiled springs 11 and is adapted to be rotated about the pivot shaft 10 against the force of the springs 11 from the first position indicated by the solid lines to the second position indicated by the imaginary lines in FIG. 4.

Figure 2:
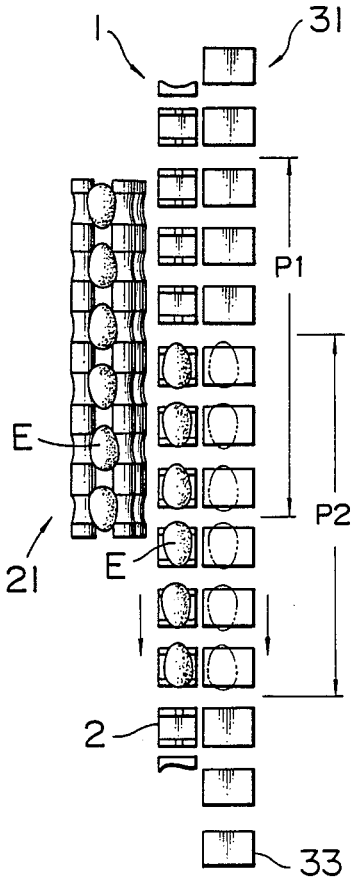
FIG. 2 shows an intermediate state of delivering the received objects to be processed to a secondary conveyor.
Figure 3:
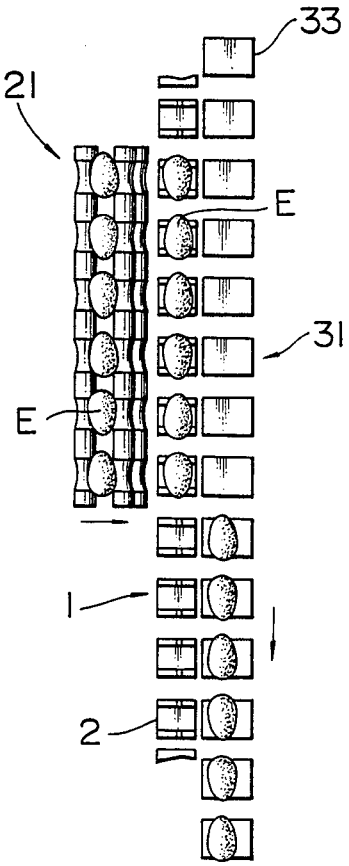
FIG. 3 shows a state in which the transfer of the objects to be processed has been completed and then the objects are received from the delivery conveyor again.

In this embodiment, in the case of the transfer of eggs E, one lot consisting of six eggs E is delivered from the delivery conveyor 21 at one time, as shown in FIGS. 1 and 3, and each egg E is received by each swingable receiving stand 2. Thereafter, as shown in FIG. 2, the receiving stands 2 are moved forward by means of the chain 8 in the direction of the arrow by a predetermined distance substantially three times as much as the distance between the adjacent individual receiving seats 24 of the delivery conveyor 21, and then the six eggs E are simultaneously transferred to the respective supporting stands 33 of the secondary conveyor 31, as indicated by imaginary lines in FIG. 2.

More particularly, as shown in FIG. 3, the receiving stands 2 are temporarily stopped when they receive eggs E from the delivery conveyor 21 and then accelerated to a speed equal to that of the secondary conveyor 31. When the receiving stands 2 have been moved by said predetermined distance from the stopped position as shown in FIG. 2 and the supporting stands 33 and the receiving stands 2 are aligned transversely with each other, the received eggs E on the receiving stands 2 are simultaneously transferred onto the respective supporting stands 33.

As shown in FIG. 2, the egg receiving section P1 in which the eggs E are received from the delivery conveyor 21 onto the receiving stands 2 and the section P2 in which the eggs E on the receiving stands 2 are transferred onto the supporting stands 33 have an overlapped section equal to three times the distance between the adjacent receiving seats 24 because, as described above, a lot of six eggs E (which occupy six times the distance between adjacent individual receiving seats 24) is received and when the eggs thus received are moved by three times the distance, they are transferred to the secondary conveyor 31. It will be noted that the overlapped section is useful for shortening the time required for receiving and transferring the objects. As a result, efficient transfer of the eggs is ensured and the transfer device 1 can be made compact in size. In order to transfer the eggs in the manner described above, the endless chain 8 is so arranged that after the receiving stands 2 are moved at least by nine times the distance between the adjacent individual receiving seats 24 of the delivery conveyor 21 in a direction perpendicular to the direction of the movement of the delivery conveyor 21; that is, after the receiving stands 2 have moved in parallel with the direction of the movement of the secondary conveyor 31, the receiving stands 2 are swung downwardly and then upwardly, whereby the transfer of eggs can be accomplished.

The endless chain 8 is intermittently driven by a drive device 36 (FIG. 4) such as a conventional crank device, a cam mechanism or the like. The intermittent driving means 36 can be suitably designed and fabricated depending on the number of eggs simultaneously delivered from the delivery conveyor 21.

Next, an example of means for rotating the swingable receiving stands 2 will be described below. Referring to FIGS. 4 and 5, reference numeral 13 denotes a lift bar which is connected through arms 15 to a rotatable shaft 14 which can be driven, for example, by the intermittent driving device 36. As shown in FIG. 6, the lift bar 13 is kept in contact with the lower surface of the follower parts 7 of the receiving stands 2 within the transfer section P2. When the shaft 14 is rotated counterclockwise in FIG. 4, the lift bar 13 lifts simultaneously the follower parts of six receiving stands 2 within the transfer section P2 so that the receiving stands 2 are swung to be inclined toward the supporting stands 33 of the secondary conveyor 31, whereby the eggs E are transferred onto the supporting stands 33. After the transfer of the eggs E, the lift bar 13 is rotated in a clockwise direction to release the follower parts 7 whereby the receiving stands 2 are smoothly returned to their initial positions, respectively, under the forces of the coiled springs 7. Instead of providing the return means just described above, it is possible to directly interconnect each swingable receiving stand 2 and each mounting member 9 through a spring.

Instead of the means for rotating the swingable receiving stand 2 which has been so far described as the lift bar 13, conventional means such as solenoids, hydraulic cylinders, cam mechanisms and the like may be used.

As shown in FIG. 4, the intermittent driving device 36 is controlled by a control device 37, which may be a mechanical or electric controller for controlling the endless chain 8 such that it is stopped first and then accelerated to the same speed as that of the secondary conveyor 31 in timed relation with the movements of the delivery conveyor 21 and the secondary conveyor 31. The control device 37 also controls the exact timing of rotary movement of the rotatable shaft 14 for the swinging movement of the receiving stands 2 between their first and second positions.

Obviously, numerous modifications and variations of the present invention are possible in light of the above teachings. It is therefore to be understood that within the scope of the appended claims, the invention may be practiced otherwise than as specifically described herein.

What is claimed is:

1. A transfer apparatus for transferring objects to be processed such as eggs: comprising a delivery conveyor driven in a first direction for conveying the objects to be processed and having an array of individual receiving seats at which the objects to be processed rest, said array consisting of parallel rows of the receiving seats, spaced apart by a predetermined distance in said direction, each of said rows including a predetermined number of the receiving seats;

a secondary conveyor having a conveying section travelling in a second direction perpendicular to said first direction of the delivery conveyor and disposed adjacent to a delivery end of the latter, said secondary conveyor having mounted thereon a plurality of supporting stands for receiving thereon said objects, respectively, said supporting stands being spaced apart from each other in said second direction by a distance equal to the distance between adjacent receiving seats of the same row;

means for driving said secondary conveyor at a constant speed in a manner to cause the conveying section thereof to move in said second direction; and transfer means interposed between the delivery end of the delivery conveyor and the conveying section of the secondary conveyor for receiving at one time a lot of objects on each row of the receiving seats of the delivery conveyor to transfer the objects onto the supporting stands of the secondary conveyor, respectively, said transfer means having a plurality of object receiving stands spaced apart from each other in a direction parallel to said second direction by a distance equal to the distance between adjacent receiving seats of the same row for receiving the lot of objects thereon, respectively, and then transferring the same onto the supporting stands, wherein said transfer means comprises:

endless conveying means having a section which extends in said direction parallel to said second direction and carries said receiving stands thereon, each of said receiving stands being mounted to be movable between a first position in which one of the objects is received thereon and a second position in which the object received is transferred to one of the supporting stands;

intermittent drive means for intermittently driving said endless conveying means so as to move said receiving stands in said direction parallel to said second direction;

control means for controlling said intermittent drive means in such a manner that when the receiving stands receive thereon a lot of objects from the delivery conveyor, said endless conveying means is stopped with a set of the receiving stands aligned with respect to said first direction with the receiving seats, respectively, and then said endless conveying means is moved and accelerated in said second direction until the receiving stands, which have received the objects thereon, have the same speed as the supporting stands and take positions adjoining the supporting stands moving in parallel, respectively; and means for acting on said set of the receiving stands to cause each of the same to move from said first position to said second position, when said receiving stands have taken the positions adjoining the supporting stands, thereby to transfer at a time the lot of the objects on the set of the receiving stands onto the supporting stands.

2. The transfer apparatus as claimed in claim 1, wherein said control means controls said intermittent drive means in such a manner that when the receiving stands have taken the positions adjoining the support stands, some of the receiving stands are still in the range of the delivery end of the delivery conveyor.

3. The transfer apparatus as claimed in claim 1, which comprises means for pivotally mounting each of said receiving stands on the endless conveying means so as to be swingable between said first and second positions.

4. The transfer apparatus as claimed in claim 3, wherein the receiving stands have follower parts, respectively, and said means for acting on the set of the receiving stands comprises a lift bar adapted to act on the follower parts to impart forces to the receiving stands so as to swing them from the first positions to the second positions thereof.

5. The transfer apparatus as claimed in claim 4, wherein the receiving stands comprise spring means acting thereon to return the receiving stands to their first positions when the lift bar ceases to impart forces to the receiving stands.

* * * * *